United States Patent [19]

Terilli

[11] 3,990,707

[45] Nov. 9, 1976

[54] ROUTE SALESMAN GAME

[76] Inventor: Albert Terilli, High View Drive, Carmel, N.Y. 10512

[22] Filed: Apr. 18, 1975

[21] Appl. No.: 569,503

[52] U.S. Cl. ..... 273/134 C; 273/134 D; 273/134 GM; 273/134 AT

[51] Int. Cl.[2] ..... A63F 3/00

[58] Field of Search ..... 273/134

[56] References Cited

UNITED STATES PATENTS

| | | | |
|---|---|---|---|
| 1,455,045 | 5/1923 | Conde | 273/134 C |
| 1,505,071 | 8/1924 | Fraser | 273/134 AD |

FOREIGN PATENTS OR APPLICATIONS

| | | | |
|---|---|---|---|
| 709,543 | 5/1954 | United Kingdom | 273/134 C |

*Primary Examiner*—Delbert B. Lowe
*Attorney, Agent, or Firm*—Ladas, Parry, Von Gehr, Goldsmith & Deschamps

[57] ABSTRACT

A route salesman game board for a plurality of players, comprising a flat stationary board having defined on one surface thereof: a plurality of two-way streets interconnected to form a two-way street system, the streets being divided along their length into a plurality of discrete areas, having a plurality of areas designated as traffic violation areas and a plurality of said discrete areas designated as special event areas; a plurality of retail store areas each having an entrance way to said system; a plurality of retail establishment areas each having an entrance way to said system; and a plurality of starting points each providing an access to said system. The game board has in combination with it two delivery truck pieces uniquely identifiable with each player, fifty stackable soft-drink cases uniquely identifiable with each player and three sets of game cards providing instructions for players during the playing of a route salesman game on the game board.

8 Claims, 7 Drawing Figures

ROUTE SALESMAN GAME

The present invention relates to a route salesman game utilizing a game board and other components for use by two, three or four players in competition with one another to establish, in accordance with chance and player skill, the best route salesman among the players.

It is an object of the invention to provide a novel competitive route salesman game which can be played for recreational purposes by two, three or four persons.

According to the invention there is provided a route salesman game board, for a plurality of players, comprising a flat stationary board having defined on one surface thereof: a plurality of two-way streets interconnected to form a two-way street system, the streets being divided along their length into a plurality of discrete areas, having a plurality of areas designated as traffic violation areas and a plurality of said discrete areas designated as special event areas; a plurality of retail store areas each having an entrance way to said system; a plurality of retail establishment areas each having an entrance way to said system, and a plurality of starting points each providing an access to said system.

Embodiments of the invention will now be described, by way of example, with reference to the accompanying drawings, in which.

Figure 6:
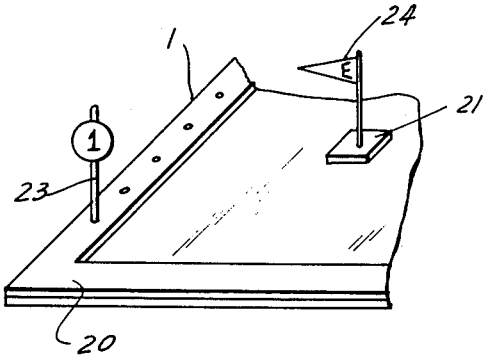
Figure 5A:
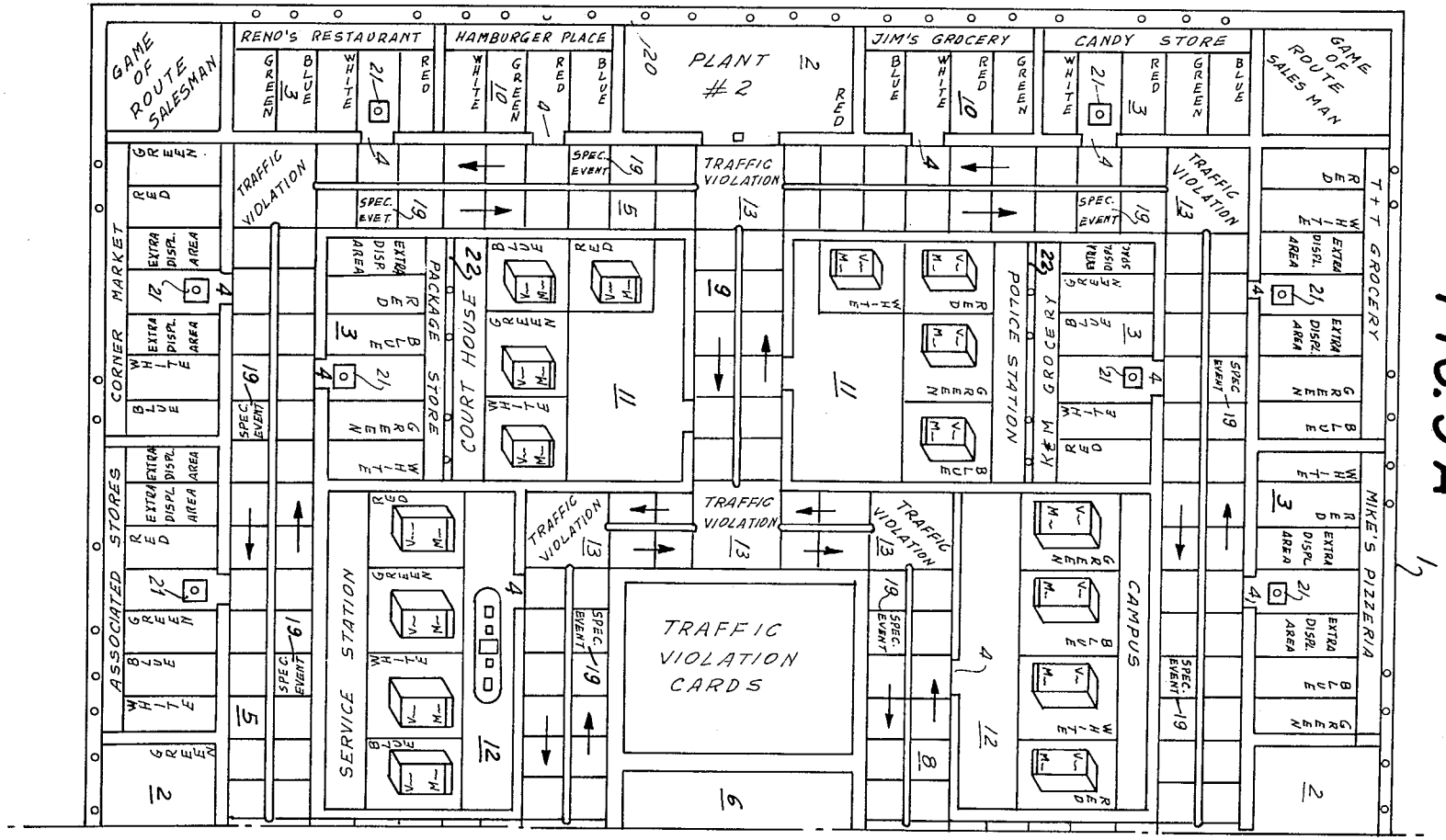

FIG. 5A and B is a layout of a typical specific example of a second embodiment of game board; and FIG. 6 is a fragmentary perspective view of a corner portion of the game board of FIG. 5A and B.

Figure 1:
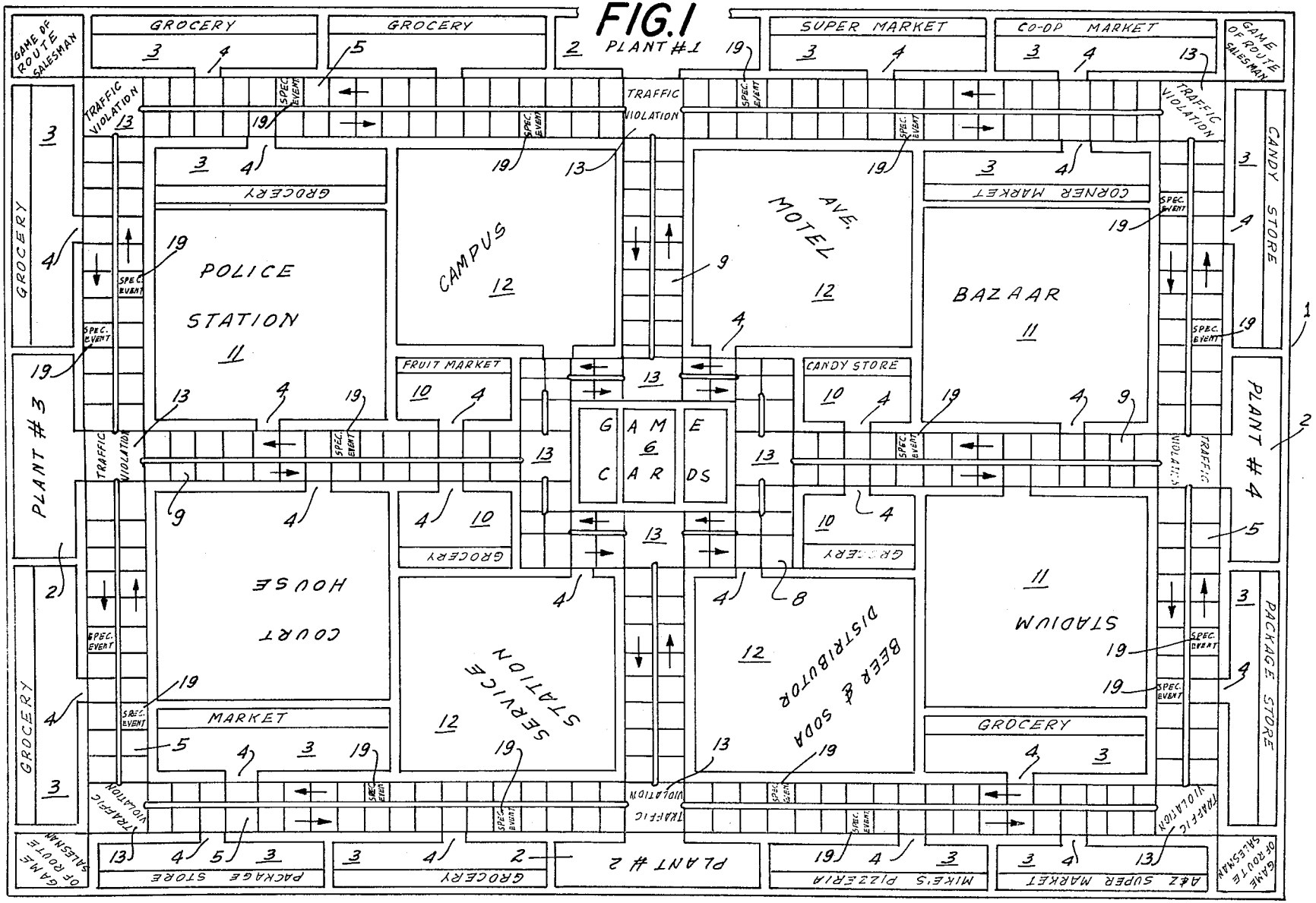
FIG. 1 is a general layout of a flat stationary game board of a first embodiment.

With reference to FIG. 1 of the drawings, a game board 1 according to the first embodiment of the invention is of rectangular configuration having four distribution starting points 2 respectively disposed centrally of each side of the rectangular board. Disposed around the periphery of the board are twelve retail store areas 3 variously named, for example, grocery, supermarket, co-op market, candy store, package store, A & Z supermarket, and Mike's pizzeria. Each retail store area 3 has an entrance 4 facing inwardly of the board onto two-way divided streets 5 extending around the game board 1 to form a rectangle. Adjacent each corner of the game board 1, and having entrances 4 to the opposite side of the street 5 from the peripheral retail store areas 3, are a further four retail store areas 3.

Disposed centrally on the game board 1 is a rectangular area 6 of a size to carry three stacks of game cards 7 arranged side-by-side. Around the rectangular area 6 is disposed a rectangular two-way divided traffic circle 8 from which extend four two-way divided streets 9 serving to connect the traffic circle 8 with the two-way divided streets 5. The streets 9 are symmetrically disposed to divide the area within the streets 5 into four discrete equal areas each of which is divided into a retail store area 10 having an entrance onto a street 9, a retail establishment 11 having an entrance onto a street 9 and a retail establishment 12 having an entrance to the traffic circle 8. The junction of any two streets, with the exception of the corners of the traffic circle 8, is designated as a traffic violation area 13.

Each street has arrows indicating the direction of traffic flow and has its length divided into a plurality of like rectangles.

Distributed around the street system, each related to a single one of the rectangles into which the streets are divided, are special event areas 19.

Figure 2:
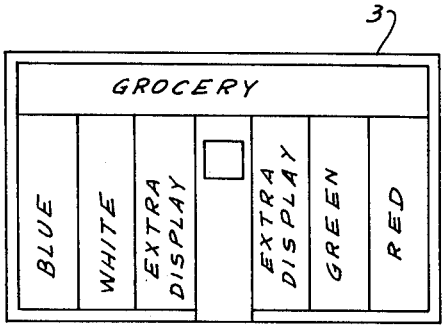
FIG. 2 is a typical layout of a retail store of the game board of FIG. 1.

FIG. 2 shows one typical layout of a retail store area 3 including display rack spaces for each route salesman, as defined by the colors blue, white, green, red, together with two extra display spaces not designated for any particular player. It will be appreciated that the layout may be varied from one area 3 to another and that the display rack spaces may be arranged to hold different numbers of soft drink cases 14.

Figure 3:
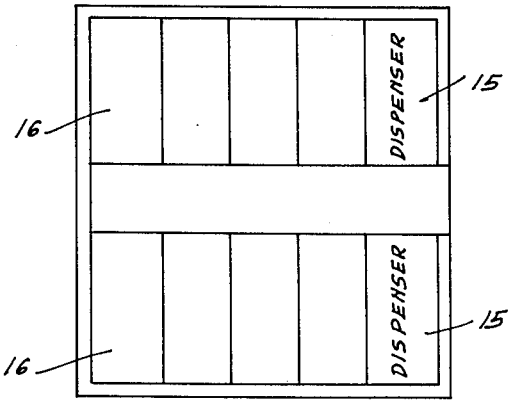
FIG. 3 is a typical layout of a retail establishment of the game board of FIG. 1.

FIG. 3 shows one typical layout of retail establishment 11, 12 which may, for example, be a police station, court house, campus, service station, motel, beer and soda distributor, bazaar or stadium. The typical layout has two soft drink dispensing machines 15 and a storage area 16 for nine cases of soft drink 14. It will be appreciated that the layout of the retail establishments may be varied with respect to the number of dispensing machines 15, the number of cases of soft drink 14 which can be stored in the storage area 16 and the allotment of spaces in the storage area 16 to individual route salesmen. In the typical example shown in FIG. 3 no allotment of space in the storage area 16 is made to any individual route salesman.

Figure 4:
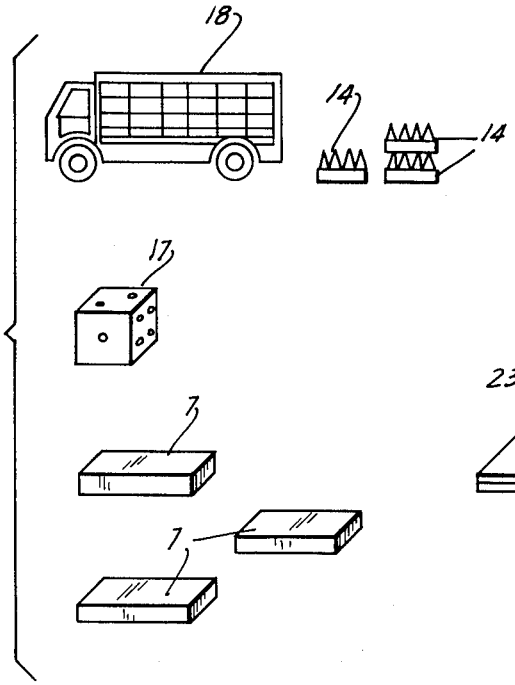
FIG. 4 illustrates other components which are used together with the game board of the first embodiment.

With reference to FIG. 4, each route salesman is provided with a pair of dice 17, two like model delivery trucks 18 of a size small enough to be associated with a single one of the rectangular areas into which each street is divided and fifty replica cases of soft drink 14 of a size to fit as desired within the areas provided on the game board for display and storage of such cases of soft drink. The delivery trucks 18 and cases of soft drink 14 of each individual salesman are identified by a single color blue, white, green or red and the delivery trucks 18 and cases of soft drinks 14 of different route salesman are identified by a different one of the colors blue, white, green, and red.

Three sets of game cards 7 are provided for use in the game. The sets are route service cards, traffic violation cards and special event cards.

The route service cards each contain an instruction on one side only. There are thirty-four route service cards having instructions as follows:

On card - deliver two cases to market,

One card - deliver three cases to A & Z market,

One card - deliver two cases to Package store,

Two cards - proceed to next outlet and replace two competitor cases,

Two cards - double your next delivery,

One card - make the next outlet exclusive account with your product providing it is not a competitor exclusive account, One card - Service Station needs product go directly to station and deliver two cases, One card - Court House needs product go directly to court and deliver two cases, One card - deliver two cases to Co-op Market, One card - deliver three cases to Mike's Pizzeria, One card - deliver two cases to Supermarket, Two cards - proceed to next outlet and replace one competitor case, Two cards - go directly to an "exclusive account" replace two competitor cases, One card - Bazaar needs two cases go directly to bazaar and deliver your product, One card - Police Station needs product go directly to station and deliver two cases, One card - Campus needs product go directly to Campus and deliver two cases, Two cards - buyer out Do Not Deliver Hold issue to competitor, Two cards - out of business Do Not Deliver Hold issue to competitor, Two cards - poor salesmanship return one case from last service, to plant, One card - over stocked return two cases from any market to plant, Two cards - return to plant ran out of product lose one turn, One card - poor pricing lose two cases to competitor on your left, Two cards - did not rotate stock lose one case to competitor on your right, Two cards - return to last service you forgot to collect for delivery, The traffic violation cards each contain an instruction on one side only. There are eighteen traffic violation cards having instructions as follows:

Two cards - lose one turn for passing stop sign,

One card - go back five spaces failure to use turn signals,

One card - go back three spaces did not turn wheels into curb on hill,

One card - accident go directly to Police Station and file report do not deliver, Two cards - lose one turn wrong way on one way street, One card - violation go directly to Court House and pay fine do not deliver, One card - road in repair lose one turn, Two cards - engine trouble go directly to Service Station for repair lose one turn do not deliver, One card - double parked go directly to Court House and pay fine do not deliver, Two cards - flat tire lose one turn, One card - red light lose two turns you did not stop, One card - blocking traffic during delivery lose one turn, One card - stop lights do not work go back to plant lose one turn, One card - improper U-turn lose two turns, The special event cards each contain an instruction on one side only. There are eighteen special event cards having instructions as follows:

One card - special sale deliver five cases to Co-op Market,

Two cards - home game deliver five cases to Stadium,

One card - vending machine empty deliver five cases to Service Station,

One card - vending machine empty deliver five cases to Avenue Motel,

One card - vending machine empty deliver five cases to Court House,

One Card - vending machine empty deliver five cases to Police Station,

One card - price reduction deliver three cases to Mike's Pizzeria stack your cases, One card - product promotion deliver three cases to Market stack cases, One card - special sale deliver five cases to Bazaar, One card - holiday sales deliver five cases to A & Z Market stack cases, One card - graduation exercises deliver five cases to campus, One card - holiday sales deliver five cases to beer distributor, Two cards - holiday sales triple your next delivery stack your cases, One card - sold out deliver three cases to candy store stack your cases, One card - low stock deliver three cases to stadium stack cases, Players using the game board and components of the route salesman game are known as route salesmen and are each identified by one of the four colors, blue, white, green, red. Each player has two dice 17, two trucks 18, and fifty cases of soft drinks 14. The cases of soft drink 14 are individual pieces arranged for stacking one upon another.

Each route salesman is associated with a different starting point 2 and at the start of the game each route salesman in turn throws one die 17 and moves one of his trucks 18 one space along a street 5 for each count of the die. The route salesman may choose any route of travel providing street arrows are followed. One case of soft drinks 14 may be delivered to a retail store area 3, 10 or a retail establishment 11, 12 when the route salesman's truck at the end of an account stops in the rectangle of a street 4 immediately outside of the entrance to such a store or establishment. Delivery may only be made from the side of the street 5 on which the entrance is located. More than one case of soft drinks 14 may be delivered only when so instructed by game cards.

Each route salesman must cover the display rack or storage area identified as his own and then any extra display area before cases of soft drink 14 may be delivered to a competitor's rack or storage area in the same store or establishment. The rules of the game may be varied to require one or a stacked plurality of cases of soft drink 14 to constitute cover of a display rack or storage space.

A retail area 3 may be claimed as an "exclusive account" when all of that salesman's display areas, extra display areas and one other route salesman's display areas in that retail store are covered by his own cases of soft drink 14. The four stores 10 are not permitted to become exclusive. The establishments 11, 12 may or may not become "exclusive accounts" in various arrangements of play.

Card instructions must be followed when picked or given by a competitor salesman. Route service cards are picked when any route salesman throws a count one of a die. Traffic violation cards are picked when a route salesman's truck stops on an area of a street marked "traffic violation". Special event cards are picked when a route salesman's truck stops on a rectangle of a street marked "special event".

The retail establishments 11, 12 are restricted to ten cases of soft drinks per route salesman.

Upon gaining three "exclusive accounts" a route salesman may begin using his second truck and throwing two dice in his turn, each truck being moved in accordance with the count of one of the dice. If an "exclusive account" is lost and the route salesman concerned then has less than three "exclusive accounts", he is once again restricted to the use of a single truck. When a route salesman is entitled to use two trucks he is restricted to a single route service card or special event card for each throw of the dice, but must take two traffic violation cards if both of his trucks stop in traffic violation areas.

The game is won when the first one of the route salesmen delivers fifty cases of soft drink, but the game can continue to ascertain second and third places if the appropriate number of players are involved. The game is appropriate for playing by two, three or four route salesmen.

Figure 5B:
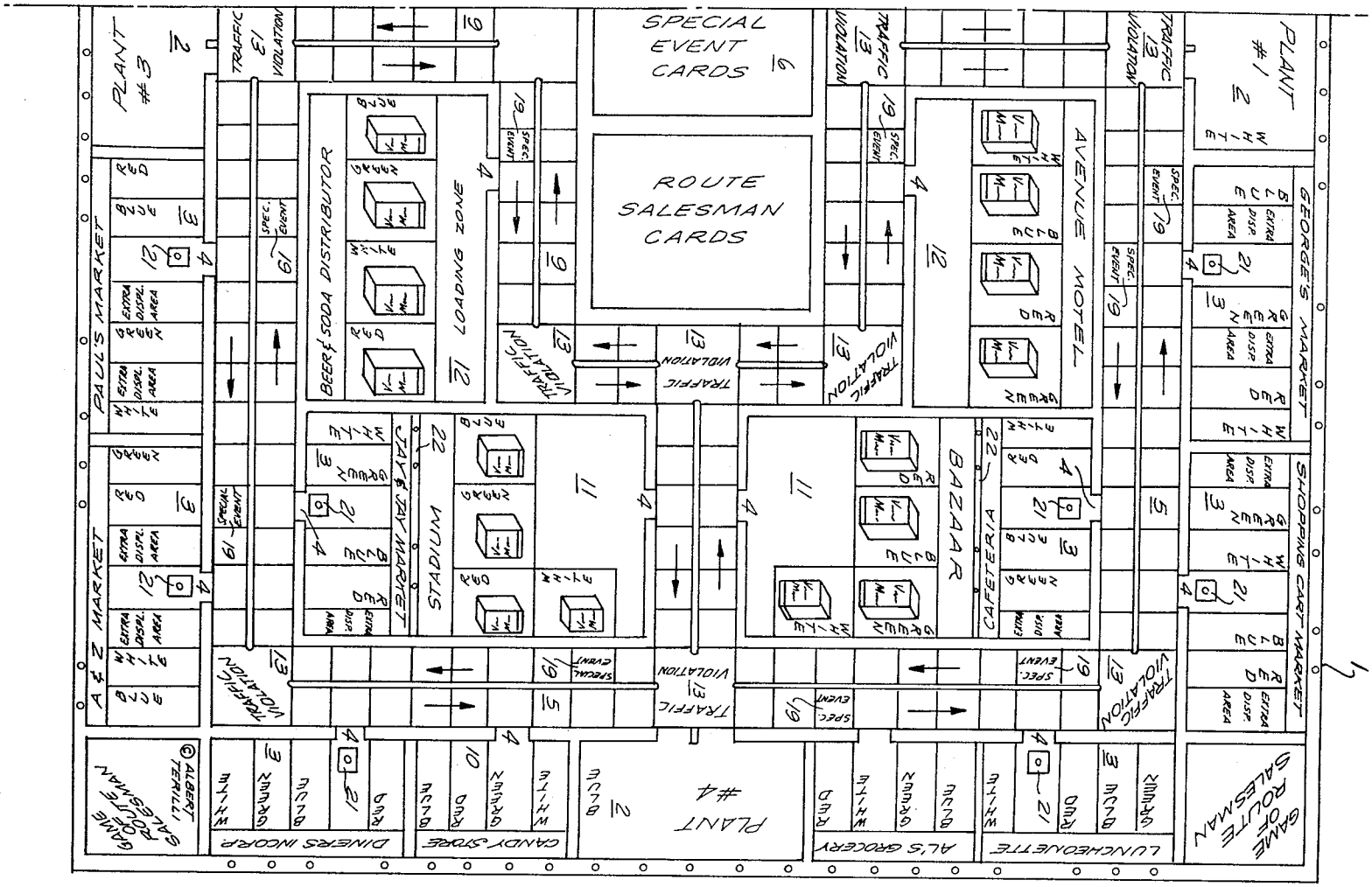

The second embodiment of the invention as illustrated in FIG. 5 follows the same general layout as the arrangement shown in FIG. 1, but differs therefrom by moving the retail stores 10 from the central location shown in FIG. 1 to a peripheral location, by adding traffic violation areas 13 at the corners of the traffic circle 8 and by providing discrete vending machine areas for each route salesman in each of the retail establishments 11 and 12. In addition, the board of FIG. 5, and as shown in the fragmentary perspective view of FIG. 6, has a raised perimeter 20, raised exclusive marker areas 21, and raised marker areas 22 associated with each retail area 3 located centrally of the board. The raised perimeter 20 and marker areas 22 have four post holes associated with each retail store area 3 and 10 to accommodated route markers 23. The raised exclusive marker areas 21 are associated one with each retail store area 3 and each have a post hole to accommodate a single exclusive marker 24. The raised perimeter 20 adjacent each of the starting points 2 has five post holes each to accommodate an exclusive marker 24.

Although not illustrated, for the sake of clarity, it is intended that the game board as shown in FIG. 5 have imprinted thereon illustrations of a typical shopping area, thereby to provide greater realism.

With the game board of the second embodiment, as illustrated in FIG. 5, would be provided components of the game as illustrated and described above with reference to FIG. 4. In addition, each player would be provided with twenty route markers 23 and five exclusive markers 24, the colors of the markers 23 and 24 corresponding to the identifying color blue, white, green or red of the particular player concerned. The twenty route markers 23 would be numbered respectively 1 through 20.

The manner of playing the game as illustrated in FIG. 5 follows the same basic concept as that described above with reference to FIGS. 1 through 4 and is distinguished from that concept in the following manner. The game starts with each route salesman placing his route markers in numerical order in the post holes provided for this purpose to indicate a route sequence he will use during the beginning of the game. There is no restriction on the arrangement or sequence in which a route salesman may place his route markers, one to each chosen retail store area 3, 10. At the commencement of the game each player stores his five exclusive markers 24 in the post holes of the raised perimeter 20 associated with his starting point.

Following placement of the route markers 23 the game commences as described with reference to FIGS. 1 to 4 except, as mentioned previously, that the route salesmen are each restricted to following the route sequence defined by the numerical sequence of their associated route markers 23. When a route salesman is instructed by a game card to serve an outlet which takes him out of his route sequence, he does so by "jumping" directly to that outlet but must then travel back along the street system to the next delivery point on his delivery sequence before continuing his route sequence. When a route salesman makes a delivery to a retail store area 3 or 10, in accordance with his route sequence, his route marker 23 associated with that area 3 or 10 is removed from the board. A route salesman's route marker 23 associated with any area to which he makes a delivery on the instruction of a game card is also removed from the board at that time.

Once the delivery sequence indicated by the route markers 23 has been completed the route salesman concerned is permitted to service any retail store area 3, 10 or retail establishment 11, 12 in any sequence. Once all designated spaces in an area 3, 10 or establishment 11, 12 have been covered by soft drink cases, delivery of additional soft drink cases may be made by stacking of the cases one upon another. "Exclusive accounts" are marked by an exclusive marker 24 placed in the post hole of the appropriate exclusive marker area 21. Only retail areas or establishments which have areas 21 can become "exclusive accounts".

It is inherent in the game as described with reference to FIG. 5 that a route salesman cannot acquire exclusive accounts until he has completed his route sequence and is able to deliver in any sequence he desires. In a variation of the game described with reference to FIGS. 1 to 4 a route salesman's second truck is permitted operation upon the acquisition of two "exclusive accounts".

In a variation of that earlier arrangement the winner of the game may be determined, when the game ends by one player delivering all of his soft drink cases, by awarding points as follows, five points for completing the route sequence, three points for each exclusive account in existence at the end of the game, one point for each soft drink case delivered and five bonus points for the route salesman who delivered all of his soft drink cases. The points awarded are totaled to determine the winner on the basis of the highest point score.

It will be apparent that a number of variations, readily apparent to a man skilled in the art, of the game board layout, components for use with the game and rules in accordance with which the game is played are possible without departing from the inventive concept.

I claim:

1. A route salesman game board for a plurality of players, comprising a flat stationery board having defined on one surface thereof:

a plurality of two-way streets interconnected to form a two-way street system, the streets being divided along their length into a plurality of discrete areas, having a plurality of areas designated as traffic violation areas and a plurality of said discrete areas designated as special event areas, a plurality of areas representing establishments, including retail stores, each having an entrance way to said system, and a plurality of starting points each providing an access to said system; in combination with two simulated delivery truck pieces uniquely identifiable with each player and of a size to be uniquely identifiable with, when placed on a said street, a single one of said discrete areas, fifty stackable simulated cases of soft drink uniquely identifiable with each player, a random chance selector for selecting a number by chance, a set of route service cards providing instructions thereon for players, a set of traffic violation cards providing instructions for a player who becomes associated with a said traffic violation area, and a set of special event cards having thereon instructions for a player who becomes associated with a said special event area.

2. A route salesman game board according to claim 1 wherein each retail store area defines a plurality of display spaces, at least one display space being uniquely identifiable with each player of the game and each establishment area, other than establishments which are retail stores, defines at least a dispensing machine delivery space.

3. A route salesman game board according to claim 2 including a plurality of sequentially numbered route sequence markers for each player uniquely identifiable with that player.

4. A route salesman game board according to claim 1 wherein the street system comprises an outer rectangular arrangement of streets, an inner rectangular arrangement of streets forming a traffic circle symetrically disposed within the outer rectangular street and four symetrically disposed streets interconnecting the center of each side of the outer rectangle with the traffic circle, the traffic violation areas being disposed at a plurality of interconnection points of said streets.

5. A route salesman game board according to claim 3 wherein the board has a plurality of holes, equal in number to the maximum number of players who can play the game, associated with each retail store area and arranged each to accommodate a said route sequence marker.

6. A route salesman game according to claim 5 wherein a plurality of said retail store areas have associated therewith a single hole and each player is provided with a plurality of markers uniquely identifiable with him and each arranged for accomodation in a said hole to indicate an exclusiveness of the associated retail store area.

7. A route salesman game board according to claim 6 wherein the game board is provided with a raised periphery in which are defined a plurality of said holes and other raised portions in which are defined the remainder of said holes.

8. A route salesman game board according to claim 1 wherein the game board has the game pattern shown in FIG. 5A and B on its surface.

* * * * *